US006967271B1

(12) United States Patent
Schaff

(10) Patent No.: US 6,967,271 B1
(45) Date of Patent: Nov. 22, 2005

(54) COMBINATION CARRYING CASE AND INSTRUMENT STAND BASE

(76) Inventor: Christopher George Schaff, 18 Hillmont Cove, Jackson, TN (US) 38305

( * ) Notice: Subject to any disclaimer, the term of this patent is extended or adjusted under 35 U.S.C. 154(b) by 0 days.

(21) Appl. No.: 10/859,324

(22) Filed: Jun. 3, 2004

(51) Int. Cl.[7] ..... G10D 3/00
(52) U.S. Cl. ..... 84/327
(58) Field of Search ..... 84/327, 329, 280, 84/281; 248/443

(56) References Cited

U.S. PATENT DOCUMENTS 3,861,695 A * 1/1975 Shourek et al. ..... 280/5.24
4,445,415 A * 5/1984 Izquierdo ..... 84/177
4,684,091 A * 8/1987 Moreschi ..... 248/166
2004/0238384 A1 * 12/2004 Cameron et al. ..... 206/315.1

* cited by examiner

*Primary Examiner*—Kimberly Lockett

(57) ABSTRACT

A musical instrument support system that is a combination carrying case and foundation for instrument holding stands. The case itself would provide the foundation of the stand uprights thus eliminating the need for stand legs. The system is designed to carry multiple instrument stand support posts and provide a decorative, visually appealing foundation for instrument stands during use. This combination of stand base and carrying case will provide a cost effective, portable method of supporting musical instrument stands or other items.

9 Claims, 6 Drawing Sheets

COMBINATION CARRYING CASE AND INSTRUMENT STAND BASE

FIELD OF THE INVENTION

The present invention relates to support stands for musical instruments and, more particularly, to a economical and convenient method of transporting and supporting instrument stands.

BACKGROUND OF THE INVENTION

Excessive equipment weight, cost and setup time are three problems facing working musicians. Musical instruments, such as percussion instruments, require stands or mounting devices that position and secure them while they are being played. Musicians travel with their instruments to various locations so they desire a convenient method of packing, storing and setting up instruments for performance. To transport and setup instruments for performance requires time and effort that can be even more difficult for the musicians than actual performance. Equipment that is required for musical performance is usually heavy, expensive and time consuming to set up. For example a case of hardware necessary to set up a typical drum set would weigh more than 75 pounds. Such a case would contain very expensive hardware and be cumbersome to move from place to place. Set up time for musicians is also a problem. Musicians generally get paid only for their performance therefore any time spent setting up instruments and equipment is unpaid. Excessive equipment and instrument setup time is a problem for working musicians.

The usual arrangement by which percussionists or drummers position their instruments is to use collapsible tripod based stands that are constructed of three or more collapsible legs and a center telescoping tube that functions as the instrument stand. Another typical method of supporting and positioning such instruments is to use a rack system. Such a rack system would consist of tubes or some kind of framework to which instrument stands would be mounted.

While functional and useful, the collapsible tripod legs for instrument stands impose cost, weight and some difficulty during instrument setup. Such tripod based systems are expensive to manufacture thus expensive to purchase. These collapsible tripod bases consist of multiple moving parts, each of which must be manufactured and assembled and transported and are therefore expensive and complicated. Such stands are also difficult to set up since the moving parts sometimes bind and stick especially after significant use and wear. Some setup difficulty occurs when instruments can not be positioned where desired due to the size of the stand bases. The stand base position is limited in setup placement when adjacent to another stand. Since two stands cannot be moved close enough together, compromises in instrument placement must be made due to the limitation of stand placement. Also, the usual arrangement of tripod stands requires some method of carrying the set of stands from place to place. A typical case for this hardware imposes added cost, requires storage space when instruments are being played and may be very large and cumbersome to move. Rack systems are also expensive and require a separate case. Additionally, tripod and rack systems look distracting and can block clear sight of the performer from the audience perspective.

It is therefore an object of the invention to provide support for musical instrument stands.

It is another object of the invention to use the carrying case for instrument stands as the foundation for one or more stands.

It is another object of the invention to use the carrying case for instrument stands to eliminate the need for stand legs.

It is another object of the invention to develop instrument stands without legs to improve cost effectiveness, reduce weight and reduce setup time of instrument supports.

SUMMARY OF THE INVENTION

In accordance with the present invention, there is provided a musical instrument support system that is a combination carrying case and foundation for instrument holding stands. The case itself would provide the foundation of the stand uprights thus eliminating the need for stand legs. The system is designed to carry multiple instrument stand tubes and provide a decorative, visually appealing foundation for instrument stands during use. This combination of stand base and carrying case will provide a cost effective, portable method of supporting musical instrument stands or other items.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DESCRIPTION OF THE PREFERRED EMBODIMENT

Figure 1:
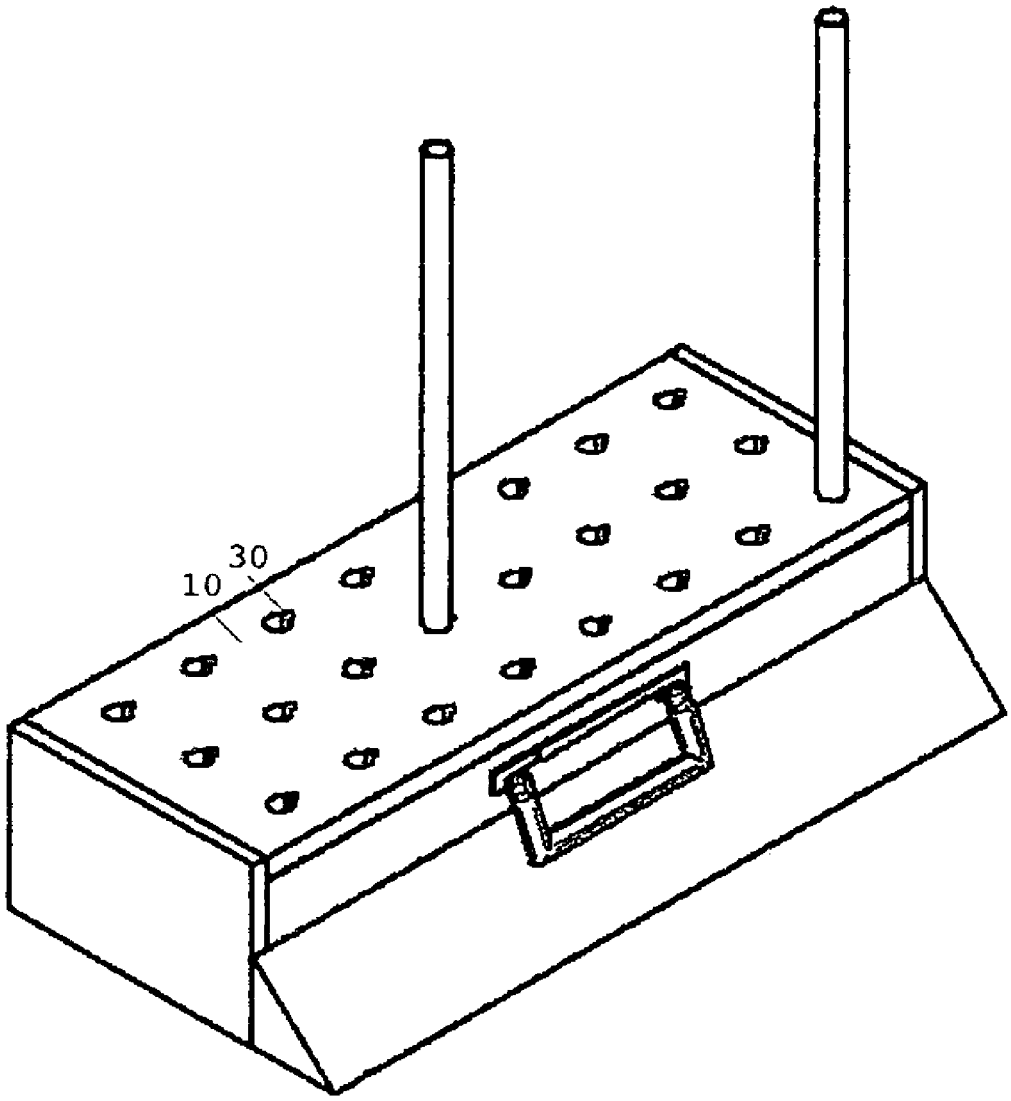
FIG. 1 is a perspective view of a combination carrying case and stand base.

FIG. 1 is a perspective view of a combination carrying case and instrument stand base. The case and stand base 10 can be used to support instrument support posts 40 during a musical performance or to transport or store support posts 40 or other items. anti rotation features 30 provide torsional support to prohibit support posts 40 from turning within the mounting holes 20. This can be achieved for example by providing a cut out in the case and stand base 10 that engages a pin or protrusion in the support posts 40 to prevent torsional motion.

Figure 2:
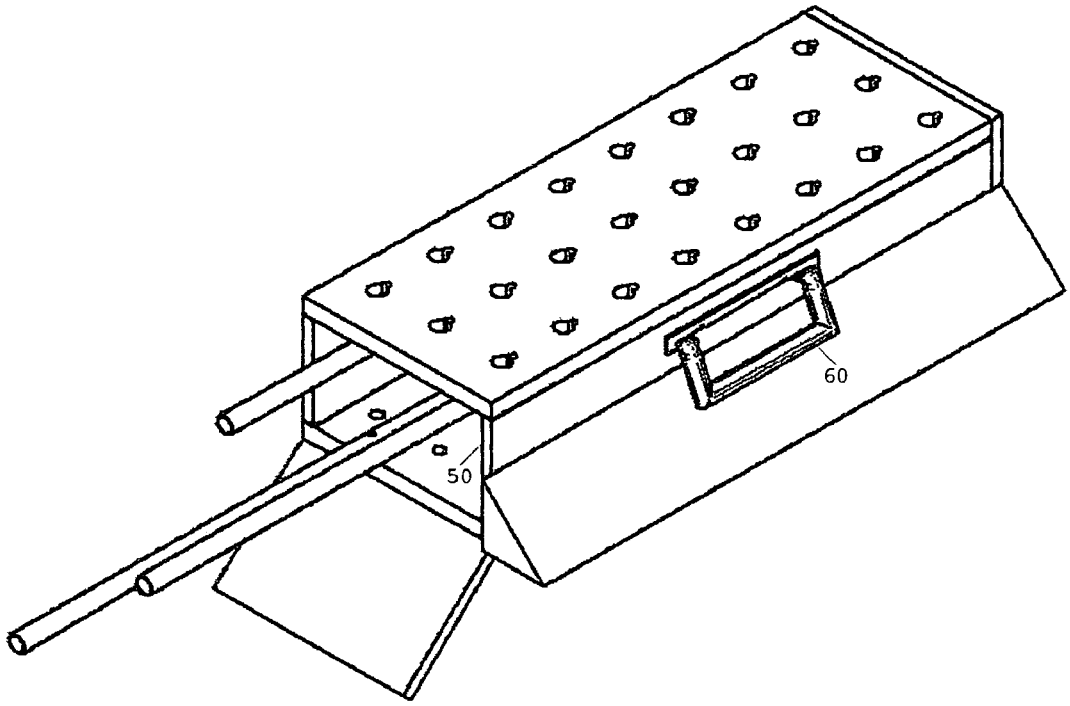
FIG. 2 is a perspective top view of a combination case and stand base used to contain support posts or other items.

FIG. 2 is a perspective top view of a combination case and stand base 10 used to contain support posts 40 or other items. Shown is a case opening 50 that is designed to provide convenient access to the case storage area. A handle 60 is attached to the case and stand base 10 to provide a means for lifting or carrying the case and stand base 10 which would typically contain telescoping support posts 40 and other items.

Figure 3:
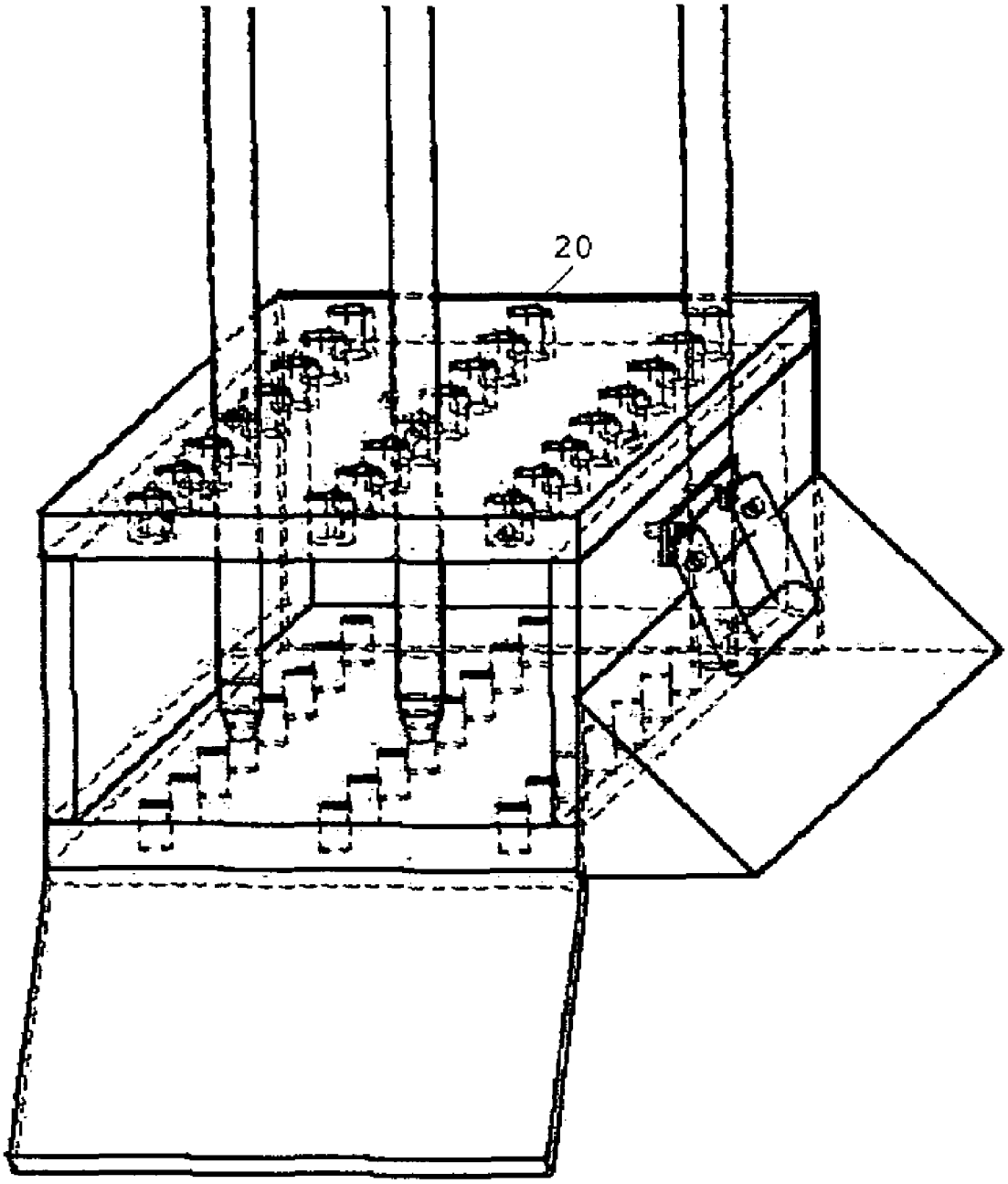
FIG. 3 is a perspective view of a combination case and instrument stand base showing stands in postition to support an instrument. Hidden lines show the aligned mounting holes supporting the instrument stands.

FIG. 3 is a perspective view of a combination case and instrument stand base showing stands in position to support an instrument. Hidden lines illustrate the aligned mounting holes 20 supporting the instrument stands. Conical shape in the end of the support posts 40 would allow the support post to position concentric with the mounting holes 20 and axially locate within the case and stand base 10.

Figure 4:
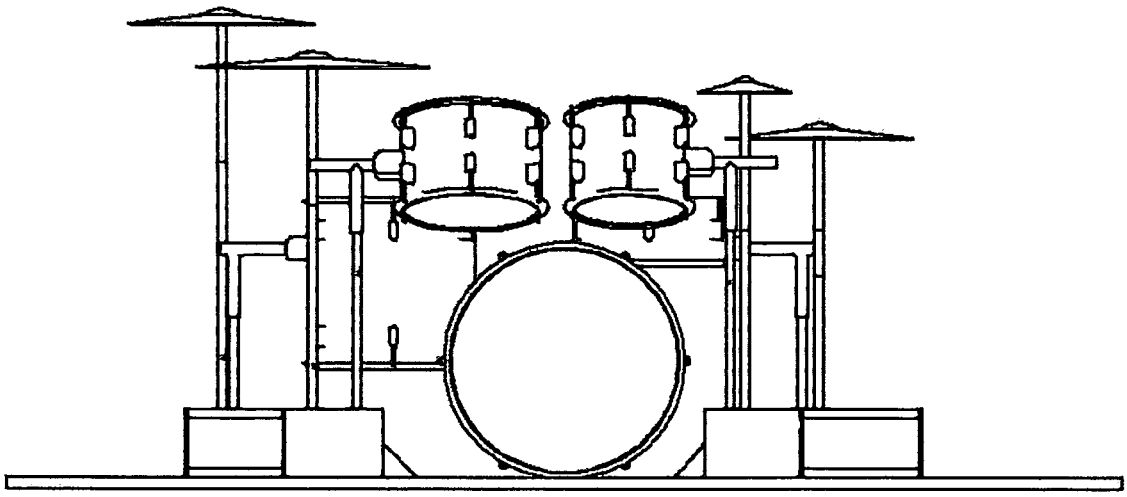
FIG. 4 is a front view of a combination case and base used as instrument stands.

FIG. 4 is a front view of a combination case and base used as instrument stands. The case and stand base 10 can be used to support various types of instruments, speakers, refreshments or any other item. The case and stand base 10 can support posts 40 that might include drums, cymbals or percussion instruments arranged for musical performance.

Figure 5:
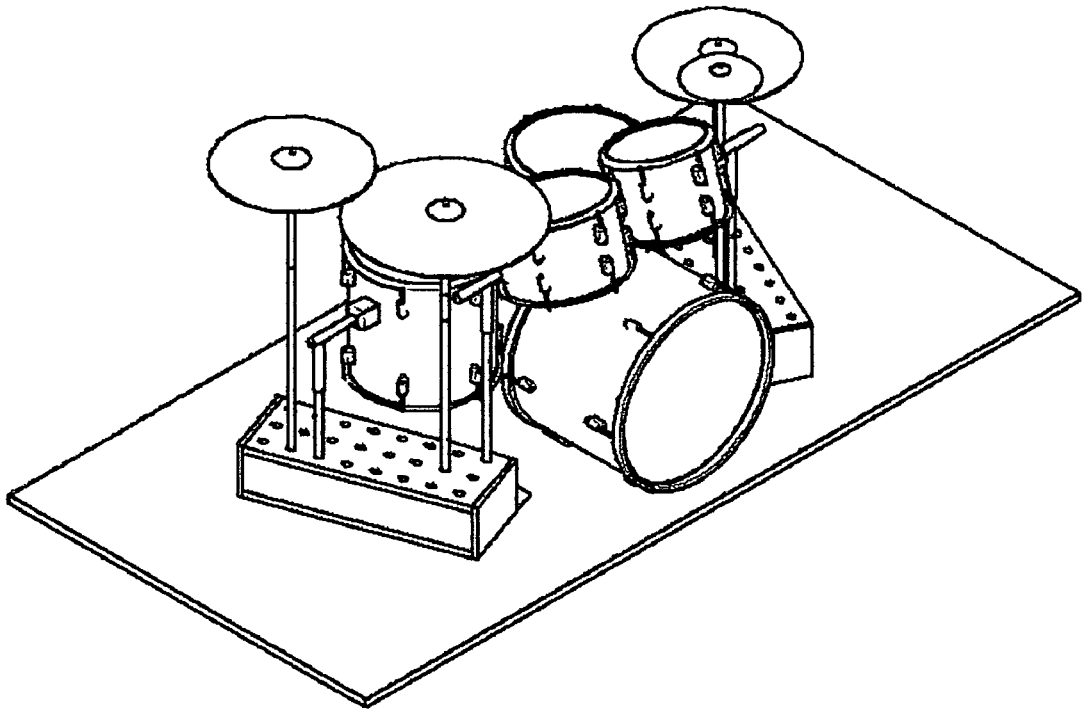
FIG. 5 is a perspective view of a combination case and base used as instrument stands.

FIG. 5 is a perspective view of a combination case and base used as instrument stands. The case and stand base 10 can be used by positioning the case and stand base 10 on the floor or performance stage such that it would provide positioning and support for musical instruments or other items in an convenient manner, and for easy access.

Figure 6:
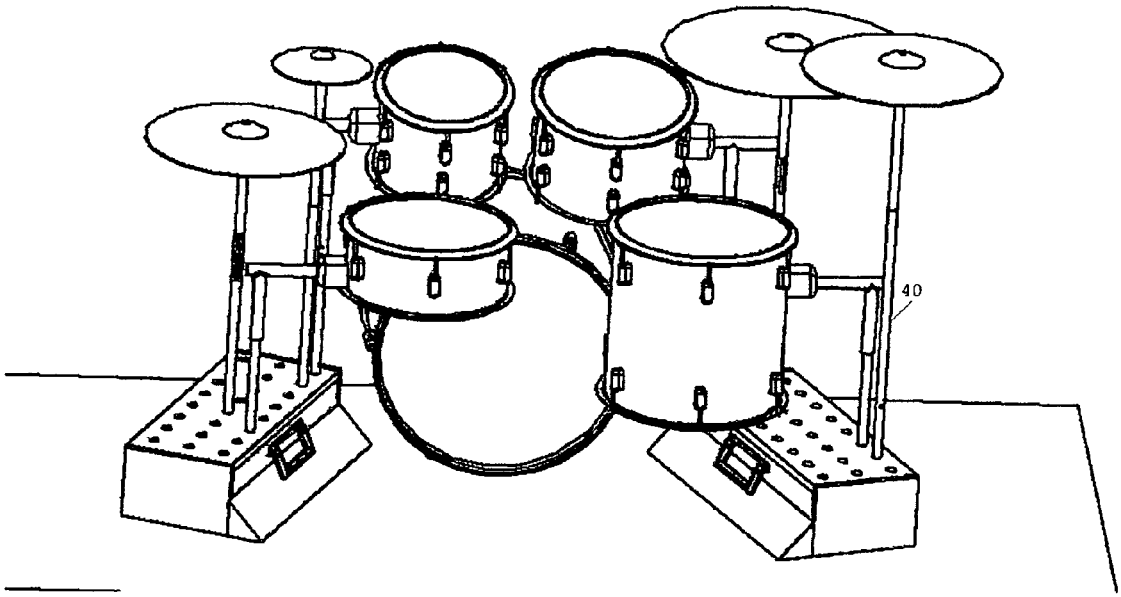
FIG. 6 is a perspective view of a combination case and base used as instrument stands.

FIG. 6 is a perspective view of a combination case and base used as instrument stands. The combination case and stand base 10 would be visually appealing and would provide a light weight since support posts 40 do not require legs. It is a cost effective and simple method of instrument setup for musicians that can be used for transporting support posts 40 and other items via a handle 60.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A combination carrying case and musical instrument stand base for transporting and supporting musical instrument holding stands comprising:

mean for supporting musical instrument on the support posts and serving as a carrying case;

means for supporting musical instrument support posts at multiple positions, placed into said means for supporting musical instruments on the support posts and serving as a carrying case;

means for preventing torsional motion of support posts within the mounting holes, conveniently constructed to said means for supporting musical instruments on the support posts and serving as a carrying case;

means for placing into the mounting holes and providing support to musical instrument, directly inserted to said means for supporting musical instrument support posts at multiple positions;

means for allowing storage of support posts or other items, conveniently constructed to said means for supporting musical instruments on the support posts and serving as a carrying case; and means for providing ease of handling for transport and lifting, conveniently attached to said means for supporting musical instruments on the support posts and serving as a carrying case.

2. The combination carrying case and musical instrument stand base in accordance with claim 1, wherein said means for supporting musical instruments on the support posts and serving as a carrying case comprises a case and stand base.

3. The combination carrying case and musical instrument stand base in accordance with claim 1, wherein said means for supporting musical instrument support posts at multiple positions comprises an array of mounting holes.

4. The combination carrying case and musical instrument stand base in accordance with claim 1, wherein said means for preventing torsional motion of support posts within the mounting holes comprises a set of anti rotation features.

5. The combination carrying case and musical instrument stand base in accordance with claim 1, wherein said means for placing into the mounting holes and providing support to musical instruments comprises a set of sufficiently rigid support posts.

6. The combination carrying case and musical instrument stand base in accordance with claim 1, wherein said means for allowing storage of support posts or other items comprises a sufficiently large, hinged or removable case opening.

7. The combination carrying case and musical instrument stand base in accordance with claim 1, wherein said means for providing ease of handling for transport and lifting comprises an handle.

8. A combination carrying case and musical instrument stand base for transporting and supporting musical instrument holding stands comprising:

a case and stand base, for supporting musical instruments on the support posts and serving as a carrying case;

an array of mounting holes, for supporting musical instrument support posts at multiple positions, placed into said case and stand base;

a set of anti rotation features, for preventing torsional motion of support posts within the mounting holes, conveniently constructed to said case and stand base;

a set of sufficiently rigid support posts, for placing into the mounting holes and providing support to musical instruments, directly inserted to said mounting holes;

a sufficiently large, hinged or removable case opening, for allowing storage of support posts or other items, conveniently constructed to said case and stand base; and an attached handle, for providing ease of handling for transport and lifting, conveniently attached to said case and stand base.

9. A combination carrying case and musical instrument stand base for transporting and supporting musical instrument holding stands comprising:

a case and stand base, for supporting musical instruments on the support posts and serving as a carrying case;

an array of mounting holes, for supporting musical instrument support posts at multiple positions, placed into said case and stand base;

a set of anti rotation features, for preventing torsional motion of support posts within the mounting holes, conveniently constructed to said case and stand base;

a set of sufficiently rigid support posts, for placing into the mounting holes and providing support to musical instruments, directly inserted to said mounting holes;

a sufficiently large, hinged or removable case opening, for allowing storage of support posts or other items, conveniently constructed to said case and stand base; and an attached handle, for providing ease of handling for transport and lifting, conveniently attached to said case and stand base.

* * * * *